US005839194A

United States Patent [19]

Bezold

[11] Patent Number: 5,839,194

[45] Date of Patent: Nov. 24, 1998

[54] FOLDING KNIFE

[76] Inventor: Urs Bezold, Märzenweg 14, D 90411 Nürnberg, Germany

[21] Appl. No.: 752,352

[22] Filed: Nov. 19, 1996

[51] Int. Cl.[6] ..... B26B 1/04

[52] U.S. Cl. ..... 30/161; 30/160

[58] Field of Search ..... 30/161, 160, 158, 30/159, 155

[56] References Cited

U.S. PATENT DOCUMENTS

| | | | |
|---|---|---|---|
| 2,250,290 | 7/1941 | Berg | 30/160 |
| 3,868,744 | 3/1975 | Miori | 30/161 |
| 4,133,106 | 1/1979 | Addis | 30/160 |
| 4,451,982 | 6/1984 | Collins | 30/161 |
| 4,502,221 | 3/1985 | Pittman | 30/160 |
| 5,111,581 | 5/1992 | Collins | 30/161 |
| 5,325,588 | 7/1994 | Rogers | 30/161 |
| 5,615,484 | 4/1997 | Pittman | 30/161 |

*Primary Examiner*—Hwei-Siu Payer
*Attorney, Agent, or Firm*—Scully, Scott, Murphy & Presser

[57] ABSTRACT

A folding knife which includes a latchable blade. The blade is pivotable about a pivoting axis or bolt between two halves of a housing.

5 Claims, 1 Drawing Sheet

Fig. 1
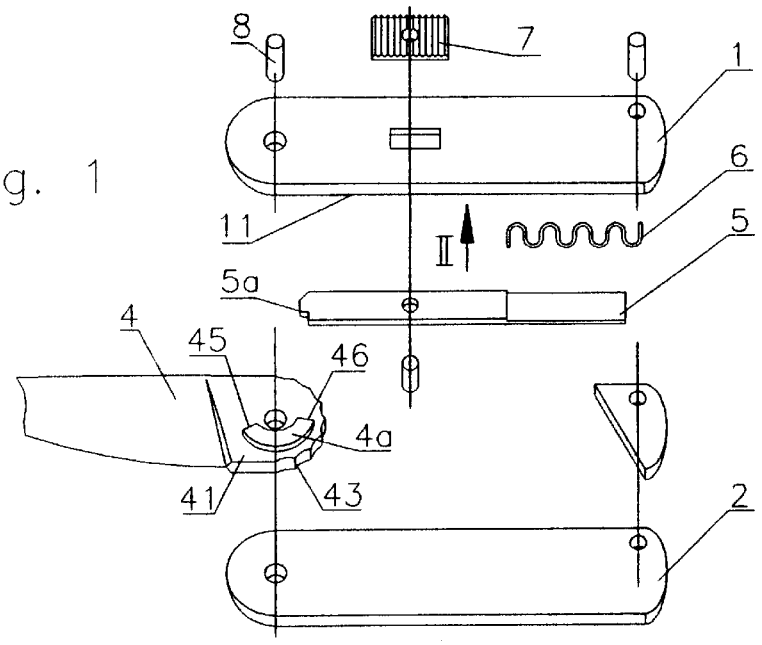
Fig. 2
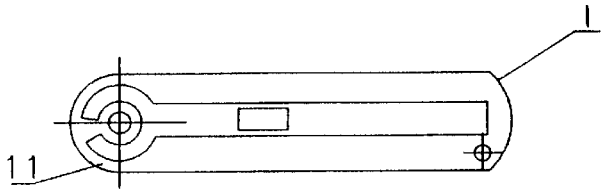
Fig. 3A
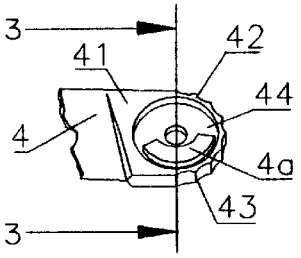
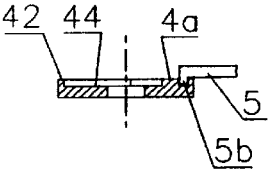
Fig.3B
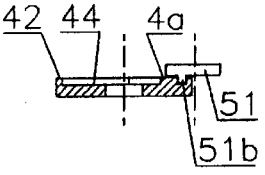
Fig.3C
Fig. 4A
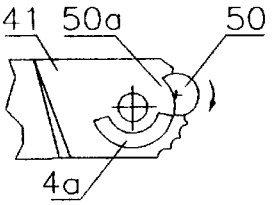
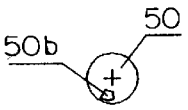
Fig.4B

FOLDING KNIFE

BACKGROUND OF THE INVENTION

1. Field of the Invention

The invention relates to a folding knife which includes a blade which can be pivoted about a bolt between two halves of a housing, and which can be locked.

2. Discussion of Prior Art

The U.S. Pat. No. 3,868,774 shows a folding knife with a cam attached to the tang which assumes the locking functions in both end positions of the blade in combination with a locking element sliding in the longitudinal axis of the knife housing. As in many other systems, the stop faces of the blade are located on the outline of the tang and form opening and closing gaps, which are accessible from the outside, in combination with the corresponding stop faces of the housing. Here particles may get into the opening as e.g. sand or dust which especially in combination with sweat, fat, fruit juice, blood etc. form a padding which is fairly adhesive and resistant to pressure. It is no longer possible to move the blade to its end position and the locking element can only partially and thus unreliably lock.

SUMMARY OF THE INVENTION

The object of the present invention is to provide a dustproof folding knife which is to be opened and closed ergonomically with one hand, with the blade to be locked safely and clearance free.

The advantage of this invention are one-hand-opening and -closing, resistance to dust, safe and clearance-free locking of the blade, the fingers do not have to be within the pivoting range of the blade when unlocking and closing, the blade cannot be pressed further when locked and therefore cannot be damaged. The tang is not weakened by any notch. In addition the knife is flat, consists of a small number of individual parts and its design is simple.

Advantageous further developments of the invention are described hereinbelow. With reference to the FIG. 3A the cam is located in a cavity 44 of the tang, the stop faces of the housing and of the locking element 5 reach from the interior of the housing into this cavity with nose 5*b,* or alternatively 51*b,* as shown in FIGS. 3B and 3C, respectively.

Concerning the FIGS. 4A and 4B, the rotating locking disc 50, having a circular recess 50*a* either grips the cam with its exterior contours or, alternatively, the disc 50 can have a nose 50*b* reaching in the cavity of the tang as shown in FIG. 4B.

According to the invention the spring-loaded locking element 5, which is provided with a wedge-shaped end 5*a,* grips to one of the terminal surfaces 45; 46 of cam 4*a,* which is located on the side of the tang 41. The terminal surface of cam 4*a* which is situated diametrically opposite in reference to the pivoting axis of the blade 4 forms the effective stop face. On both of the terminal surfaces 45; 46 of cam 4 two tangential, roughly parallel forces are acting, which bias the tang 4 against the bolt 8 in a direction which is roughly the same as the main pressure to be expected. In combination with the wedge-shaped locking element 5 the clearance resulting from manufacturing and wear and tear is thus compensated. The tang 41 which is plane in the area of the outline touches slidingly the internal surface 11 of the housing and the locking element 5 which is located within the half of the housing and which is only movable on the level of the internal surface of the housing. Thus it is not possible in any state of appliance that gaps or hollow spaces can open where dust may get into. All stop faces and locking surfaces are situated in the interior of the housing 1, respectively on the cam 4*a*. Therefore the outline 42 of the tang 41 can be freely shaped, e.g. provided with teeth 43 which enable to swing the blade 4 in and out with the index finger while the thumb of the same hand operates the button 7 for unlocking.

BRIEF DESCRIPTION OF THE DRAWINGS

Examples of designs are shown in the figures:

FIG. 1 a pocket-knife according to the invention shown in an, exploded view, FIG. 2 one half of a housing in arrow direction II from below, FIG. 3A tang and locking element, FIGS. 3B and 3C illustrate a sectional view of FIG. 3A taken along line 3—3 and showing different versions of locking element 5, FIG. 4A one locking element, FIG. 4B illustrates an alternative version of the rotary disc (50) of FIG. 3A viewed from the bottom showing nose 50*b*.

DETAILED DESCRIPTION OF PREFERRED EMBODIMENT

Referring now to FIG. 1, the folding knife has a linearity movable locking element 5 and a salient cam 4*a* which is situated on the tang 41. The C-shaped groove in one half of the housing permits a swinging of the blade 4 between the end positions. The locking element 5 is pushed by a meander-shaped spring 6 towards the bolt 8 and locks with its wedge shaped end 5*a* behind the cam 4*a.* For unlocking, the button 7 is pulled away from the blade 4, e.g. by using the thumb. The locking element 5, which is rigidly connected with the button 7, with its wedge shaped end 5*a* releases the cam 4*a,* the knife can be locked. In the closed state the locking element 5 with its oblique end is pressing on the cam 4*a* causing a torque acting on the blade 4 in the locking direction.

Referring now to FIG. 2, the housing (1) is illustrated as viewed in the direction of arrow II in FIG. 1 in which the rim region of the tang (41) slidingly passes over the internal surface (11) of the housing (1) with the movable locking element (5) which forms a close plane with the internal surface (11) of the housing (1) and is movable only in one place parallel with the internal surface (11) of the housing (1).

Referring now to FIG. 3A, an alternative embodiment of the folding knife is illustrated wherein the folding knife has a bottom surface of a recess (44) in the tang (41) in which the cam (4*a*) is located. The recess (44) has a depth corresponding to the height of the cam (4*a*), and an encompassing rim region (42) which serves for guiding and sealing relative to the housing (1) and to the locking element (5) having a thickness corresponding with the full thickness of the tang (4).

Referring back to FIG. 1 the locking element (5) for use with the recessed cam (4*a*) is illustrated wherein the locking element (5) is actuated by a spring (6) and grips the cam (4*a*) in the end positions of the blade (4) respectively with a wedge shaped end (5*a*). Alternatively, as illustrated in FIGS. 3B and 3C the locking element (5,51) can be configured for use with the recessed cam (4*a*) of FIG. 3A with a wedge shaped end (5*b*), shown in FIG. 3B, or with a wedge shaped nose (51*b*) behind the cam, as shown in FIG. 3*c*.

Referring now to FIG. 4A, the folding knife is illustrated wherein the locking element (5) comprises a rotary disc (50) which is located in the housing and is equipped with a circular recess (50*a*) corresponding to the external diameter of the cam (4*a*). Alternatively, as illustrated in FIG. 4B, showing the underside of the rotary disc 50, the disc 50 can have a nose (50*b*) which faces towards the tang (41).

I claim:

1. A folding knife with a latchable blade which is pivotable about a pivot axis between two halves of a housing; end stop surfaces for limiting the opening and closing movement of said blade which are located in a surface on a tang and located within said housing; a locking element in the housing which is movable parallel to an internal surface of the housing in the direction of the pivot axis of the blade and is alternatively positioned in contact with a cam located in said surface on a side of the tang, said cam (4*a*) being semicircular and arranged generally concentric to the pivot axis and having end surfaces (45, 46) formed at opposite ends thereof located in the direction of rotation thereof comprising the end stop surfaces of the tang (41), the locking element (5) in respective end positions of the blade (4) connecting respective one of the end surfaces (45, 46) which is not in contact with the housing so as to lock the blade (4) in that particular end position.

2. The folding knife according to claim 1, wherein a bottom surface of a recess (44) in the tang (41) in which the cam (4*a*) is located, has a depth corresponding to the height of the cam (4*a*), and an encompassing rim region (42) which serves for guiding and sealing relative to the housing (1) and to the locking element (5) has a thickness corresponding with the full thickness of the tang (4).

3. The folding knife according to claim 1, wherein a rim region of the tang (41) slidingly passes over the internal surface of the housing (11) with the movable locking element (5) which forms a close plane with the internal surface of the housing (11) and is movable only in one place parallel with the internal surface of the housing (11).

4. The folding knife according to claim 1, wherein the locking element (5) is actuated by a spring (6) and grips the cam (4*a*) in the end positions of the blade (4) respectively with a wedge shaped end (5*a*) or with a wedge shaped nose (5*b*) behind the cam.

5. The folding knife according to claim 1, wherein the locking element (5) comprises of a rotary disc (50) which is located in the housing and is equipped with a circular recess (50*a*) corresponding to the external diameter of the cam (4*a*) or a nose (50*b*) which faces towards the tang (41).

* * * * *